United States Patent [19]

Cottell

[11] 4,218,221

[45] Aug. 19, 1980

[54] PRODUCTION OF FUELS

[76] Inventor: Eric C. Cottell, Private Rd., Bayville, N.Y. 11709

[21] Appl. No.: 873,301

[22] Filed: Jan. 30, 1978

[51] Int. Cl.[2] ..... C10L 1/32; B01F 11/00

[52] U.S. Cl. ..... 44/51; 366/124; 137/624.14; 252/312; 252/314; 252/309; 252/359 R; 252/359 A

[58] Field of Search ..... 44/51; 366/124; 137/624.14; 252/312, 314

[56] References Cited

U.S. PATENT DOCUMENTS

| | | | |
|---|---|---|---|
| 2,461,580 | 2/1949 | Viczer et al. | 44/51 |
| 3,606,868 | 9/1971 | Voogd | 44/51 |

*Primary Examiner*—Patrick Garvin
*Assistant Examiner*—J. V. Howard

[57] ABSTRACT

Apparatus and method for producing a fuel comprised of oil and water in which a mixture of oil and water is constituted as an emulsion by exposure to agitation effective to cause cavitation within the mixture.

4 Claims, 3 Drawing Figures

PRODUCTION OF FUELS

BACKGROUND OF THE INVENTION

This invention is concerned with apparatus and a method for producing a fuel and with producing energy from the fuel.

In my earlier U.S. Pat. No. 3,749318 issued July 31, 1973, the advantages to be had from burning a mixture of oil and water are discussed at considerable length and there is described in that patent a combustion device which essentially comprises a housing into which an ultrasonic probe extends so that oil and water introduced into the housing adjacent the probe are emulsified and atomized for burning.

The structure described in that patent is relatively costly. According to the present invention, I seek to provide a simple and efficient apparatus and method for the production of fuel and for the production of energy from that fuel.

BRIEF SUMMARY OF THE INVENTION

According to this invention, there is provided a process for producing fuel which comprises delivering a mixture of oil and water to agitating means effective to produce an emulsion of oil and water, delivering the emulsion to a receptacle from which the emulsion is drawn on demand to an energy producing unit, monitoring the level of emulsion in the receptacle and when the level reaches a predetermined maximum, interrupting the supply of oil and water to the agitating means.

Preferably, during interruption of the supply of oil and water to the agitating means, emulsion is recirculated between the receptacle and the agitating means.

The agitating means most desirably comprises a chamber with an inlet for a mixture of oil and water and a seat at that inlet. A vibrating element cooperates with the seat and is biased into engagement with the seat to close the inlet. Means are provided for pressurizing the mixture delivered to the inlet so that the vibrating element is caused to vibrate rapidly, alternately opening and closing the inlet and in that process producing cavitation within the mixture to form an emulsion.

DESCRIPTION OF THE FIGURES OF THE DRAWINGS

An embodiment of the invention is illustrated in the accompanying drawings in which.

DESCRIPTION OF THE PREFERRED EMBODIMENT

Figure 1:
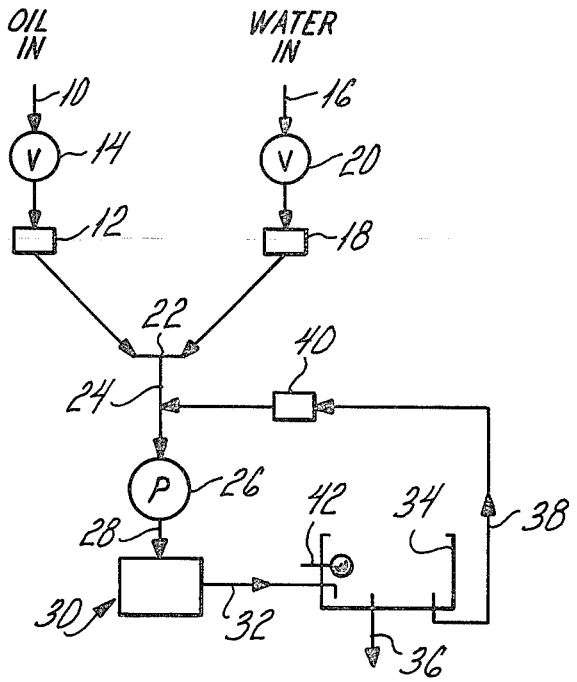
FIG. 1 shows schematically the system according to the present invention.

The system in FIG. 1 comprises a line 10 leading from an oil supply such as a tank, to a solenoid valve 12 there being a dole valve 14 in line 10, that dole valve providing a constant flow through line 10 when solenoid valve 12 is opened.

A line 16 leads from a water supply to solenoid valve 18 and includes a dole valve 20 establishing a constant flow in line 16 when valve 18 is open.

Lines 10 and 16 are united at 22 so that when valves 12 and 18 open a mixture of oil and water flows in line

24, the proportions of oil to water in that mixture being established by the valves 14 and 16.

Line 24 is connected to the intake of pump 26 and the outlet of that pump is connected by line 28 to an agitating device 30 described in greater detail hereinafter with reference to FIGS. 2 and 3. From the agitating device 30, along line 32, an emulsion of oil and water produced in the device 30 is delivered to a receptacle 34. From the receptacle 34, line 36 leads to a burner at which the emulsion is atomized and burned. Also leading from the receptacle 34 is a recirculation line 38 which, through solenoid valve 40, is connected to line 24.

Valves 12, 18 and 40 are controlled by a level switch indicated schematicaly at 42. When the level within the receptacle 34 is low, valves 12 and 18 are opened and valve 40 is closed and when the level is high, valves 12 and 18 are closed and valve 40 is opened. In the first of these conditions it will be apreciated that oil and water will pass valves 12 and 18 and be delivered to pump 26 thence to device 30 and to the receptacle to supply the burner and to fill that receptacle. In the second condition, valves 12 and 18 are closed interrupting the supply of oil and water to line 24 while valve 40 is opened so that under the influence of pump 26, emulsion is recirculated from receptacle 34 through line 38, through the piston pump 26 and thence through device 30, back to the receptacle. In this way, the pump operates substantially continuously and a constant supply of emulsion is available in tank or receptacle 34.

Figure 2:
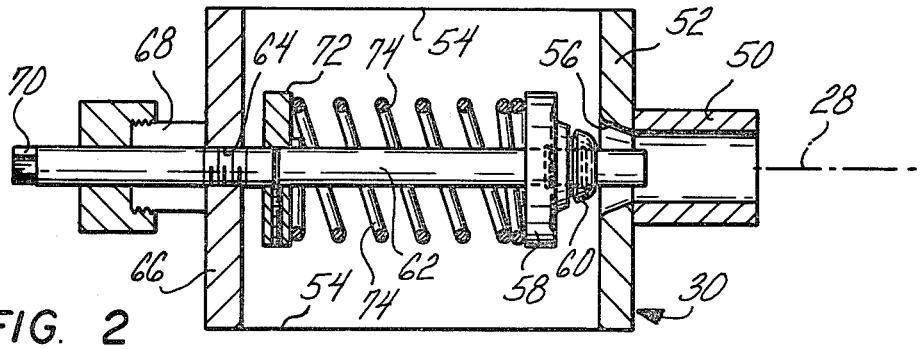
FIG. 2 is a detail of a part of the system shown in FIG. 1.

Referring now to FIG. 2 the device 30 comprises an inlet conduit 50 opening through wall 52 to the interior of a housing 54. About the opening to the interior of the housing is a conical seat 56 and a vibrating element 58 has a correspondingly shaped face 60 for cooperation with seat 56.

The element 58 is movable along shaft 62 which is mounted in a threaded opening 64 in end wall 66 opposite to wall 52. Shaft 62 extends through seal means indicated at 68 and terminates in an adjusting configuration indicated at 70. Fixed to the shaft and within the housing 54, is a back plate 72 by rotation of the shaft by means of the manipulating configuration 70, the position of the plate 72 relative to vibrating element 58 is variable. A coil spring, coaxial with the shaft 62, extends between the back plate 72 and vibrating element 58 and biases vibrating element 58 firmly into engagement with seat 56.

The inlet 50 is connected to line 24 leading from the discharge of pump 26 so that a pressurized mixture of oil and water is directed at the leading face of vibrating element 58. The pressure will cause the vibrating element 58 to move away from seat 56 allowing the pressure to be relieved and as that pressure is relieved so the coil spring 74 will move the vibrating element 58 back into engagement with the seat 56. This opening and closing of the inlet to the housing 54 will occur rapidly and will cause cavitation in the mixture and render that mixture into an emulsion. The emulsion leaves the housing by an outlet not shown in the drawings but leading to receptacle 34.

Figure 3:
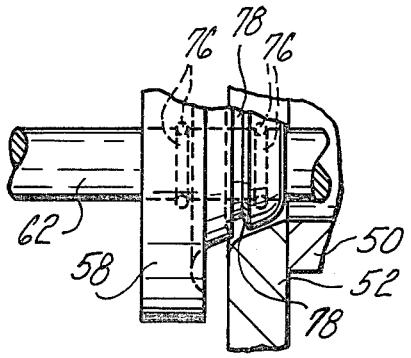
FIG. 3 is an enlargement of a portion of the apparatus shown in FIG. 2.

In FIG. 3, a detail of the apparatus in FIG. 2 is shown. The vibrating element 58 can be seen to be reciprocable along shaft 62 upon surfaces constituted by O-rings 76. Additionally, in the conical face of element 58 there is provided an annular recess 78 which promotes the cavitation effect.

It will be appreciated that careful selection of the mass of the vibrating element 58, the compression of spring 74 and the pressure of the mixture discharged from pump 26, the amplitude and frequency of the vibration of element 58 can be varied to achieve optimum emulsification of the mixture.

Most desirably according to the present invention, the mixture of oil and water delivered to the agitating device is in the proportion of 5 parts full oil to 1 parts water. The pump is one producing a pressure of about 500 to 1,000 psi and vibrating element is selected to vibrate at approximately 3,000 cps and over an amplitude of about 0.020 inches.

Such an arrangement will produce an emulsion having the following characteristics:

The oil being preponderent will form the continuous or external phase of the emulsion and the water, the discontinuous or internal phase. Thus, the conditions for sustaining micro-explosions in the combustion zone will be fulfilled. Micro-explosions being the result of the small water spheres not diffusing into steam at 100° C. as one would expect but of exploding at about 250° C. thus bring about very complete and speeded up combustion.

What is claimed is:

1. A fuel producing process comprising delivering a mixture of oil and water to agitating means effective to produce an emulsion of oil and water, delivering the emulsion to a receptacle from which the emulsion is drawn on demand to an energy producing unit, monitoring the level of emulsion in the receptacle and when the level reaches a predetermined maximum, interrupting the supply of oil and water to the agitating means and wherein said agitating means comprises a chamber having an inlet for a mixture of oil and water, a seat at that inlet, a vibrating element cooperating with said seat, biasing means pressing said vibrating element into engagement with said seat to close said inlet, said process comprising the step of pressurizing the mixture of oil and water, delivering that pressurized mixture to said inlet of said agitating means in opposition of said biasing means to cause said element to vibrate rapidly alternately opening and closing said inlet and to produce a cavitation effect in the mixture passing through the inlet.

2. A process as claimed in claim 1 wherein during interruption of said supply of oil and water to the agitating means, emulsion is recirculated between the receptacle and the agitating means.

3. A process as claimed in claim 1 wherein said vibrating element is caused to vibrate at between 50 and 20,000 cps.

4. Apparatus for producing a fuel comprises means for delivering a mixture of oil and water to agitating means, said agitating means comprising a chamber having an inlet for said mixture of oil and water, a seat at that inlet, a vibrating element cooperating with said seat, biasing means pressing said vibrating element into engagement with said seat to close said inlet, means for pressurizing a mixture of oil and water delivered to said inlet and constituting means causing said element to vibrate rapidly, alternately to open and close said inlet.

* * * * *